United States Patent [19]

Kan et al.

[11] Patent Number: 4,508,958

[45] Date of Patent: Apr. 2, 1985

[54] CEILING FAN WITH HEATING APPARATUS

[75] Inventors: Frederick S. C. Kan; Kam Wing Li; Kong Ping P. Lau, all of Kowloon, Hong Kong

[73] Assignee: Wing Tat Electric Mfg. Co. Ltd., Kowloon, Hong Kong

[21] Appl. No.: 450,169

[22] Filed: Dec. 16, 1982

Related U.S. Application Data

[63] Continuation-in-part of Ser. No. 424,789, Sep. 27, 1982.

[30] Foreign Application Priority Data

Nov. 1, 1982 [GB] United Kingdom ..... 8231200

[51] Int. Cl.[3] ..... F24H 3/04; H05B 1/00

[52] U.S. Cl. ..... 219/369; 165/122; 219/366; 219/370; 219/371; 219/373; 310/157; 416/5; 416/175

[58] Field of Search ..... 165/121, 122, 123–127; 219/366, 367, 372, 373, 374, 368–371; 98/38 F, 40 B, 40 D, 40 DL, 40 VM; 310/62, 63, 64, 67, 157; 416/5, 95, 170 R, 175, 201 A

[56] References Cited

U.S. PATENT DOCUMENTS

| | | | |
|---|---|---|---|
| 425,995 | 4/1890 | Diehl | 310/67 R |
| 465,361 | 12/1891 | Diehl et al. | 310/157 |
| 1,185,267 | 5/1916 | Vuilleumeir | 416/175 |
| 2,159,913 | 5/1939 | Tenney | 98/38 EL |
| 2,162,152 | 6/1939 | Wulle | 165/125 |
| 2,504,798 | 4/1950 | Brinen | 165/122 |
| 2,542,669 | 2/1951 | Oliver | 219/366 |
| 3,223,828 | 12/1965 | Mast | 219/370 |
| 3,458,739 | 7/1969 | Zelinski et al. | 310/62 |
| 4,391,570 | 7/1983 | Stutzman | 310/62 |
| 4,402,649 | 9/1983 | Laurel | 416/5 |

FOREIGN PATENT DOCUMENTS

| | | | |
|---|---|---|---|
| 2746464 | 3/1979 | Fed. Rep. of Germany | 310/62 |
| 1453315 | 6/1965 | France | 219/370 |
| 478417 | 1/1938 | United Kingdom | 416/5 |
| 486319 | 6/1938 | United Kingdom . | |
| 547436 | 8/1942 | United Kingdom . | |
| 561386 | 5/1944 | United Kingdom . | |
| 608569 | 9/1948 | United Kingdom | 416/5 |
| 669666 | 4/1952 | United Kingdom | 219/372 |
| 988004 | 3/1965 | United Kingdom . | |
| 1208928 | 10/1970 | United Kingdom | 219/372 |

*Primary Examiner*—Roy N. Envall, Jr.
*Assistant Examiner*—Geoffrey S. Evans
*Attorney, Agent, or Firm*—Townsend and Townsend

[57] ABSTRACT

An improved ceiling fan including a housing to be hung down from a ceiling and a motor having a stationary stator and a rotatable rotor which rotates a number of blades to create a stream of air. One or more electrical heating elements are positioned within the housing and around the outside of the rotor. A radial fan arrangement generates a flow of air through the housing, over the heating elements, and out into the stream of air created by the rotation of the blades.

14 Claims, 7 Drawing Figures

CEILING FAN WITH HEATING APPARATUS

This application is a continuation-in-part of our copending application Ser. No. 424,789, now abandoned, filed on Sept. 27, 1982.

This invention relates to ceiling fans.

BACKGROUND TO THE INVENTION

Known ceiling fans are used only in hot or warm conditions for ventilation and cooling purposes. During cold or cool conditions, known ceiling fans are usually switched off and not used. In most countries such ceiling fans are thus not used up to six months in the year and accordingly may be regarded by individuals as a luxury item.

In a room it is well known that warmer air rises to lie adjacent the ceiling while cooler air falls to lie adjacent the floor. In known ceiling fans the cooling effect of the air movement outweighs any improvement in temperature distribution when this warm air is re-circulated, even when the fan is run at a low speed.

It is an object of the present invention to overcome or mitigate one or more of the above problems.

BRIEF SUMMARY OF THE INVENTION

In accordance with the invention, a ceiling fan comprises a housing to be hung down from a ceiling, the housing containing a motor having a stationary stator and a rotatable rotor which rotates a number of blades to create a stream of air, one or more electrical heating elements positioned within the housing and around the outside of the motor and means for generating a flow of air through the housing over the heating elements for heating that air and out of the housing to mix with the stream of air generated by the rotation of the blades.

Advantageously such a ceiling fan can be used either as a conventional ventilation fan or a combined heater and fan. Furthermore such a ceiling fan can heat all the air in a room with the use of a minimum amount of energy.

Preferably the means for generating a flow of air through the housing comprises a radial fan element positioned within the housing and around the outside of the motor. The radial fan moves the air past the heating elements and into the stream of air generated by the blades. Also the movement of that air keeps the motor cool. The air is emitted from the radial fan in a tangential and radial direction into the stream of air generated by the blades.

The blades can be mounted on the rotor such that they rotate above the area where the heated air is emitted from the housing, causing the heated air to move in a downward direction. The heated air mixes with the downward stream of air and causes that air to warm up.

Alternatively the blades can be mounted on the rotor such that they rotate below the area where the heated air is emitted from the housing, causing the heated air to move in an upward direction, resulting in the heated air mixing with the upward stream of air and causing that air to warm up. The heated air does not collect against the ceiling however because the air currents generated in the room by the fan blades circulate the heated air evenly and quickly throughout the room. In particular this is often preferred to the alternative case where the hot air is driven downwardly by the blades since then the heating effect may be more localised.

In each case the stream of air caused by the blades is directed towards the area where the heated air is emitted from the housing.

In the case where the heated air is driven upwardly by the blades past the housing, there may be insufficient circulation of the cooler air at or near the axial centre of the blades. To overcome this, it is preferred to include at or beyond the axial innermost portions of the blades small supplementary blades whose angle of attack is greater than the main blades so as to increase air circulation near the axis of rotation and prevent overheating of the housing and associated parts.

Preferably, the air flowing through the housing is relatively smaller in volume and quicker moving than the volume of air in the stream created by the blades such that only a small volume of air is heated to warm up a large volume of air. Advantageously, this means that a smaller heating unit needs to be used, less energy is used for the radial fan to force the air through the housing and any heat "build up" in the housing is prevented.

A conventional ceiling fan motor is preferably used comprising a central stationary stator and an outer rotating rotor.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
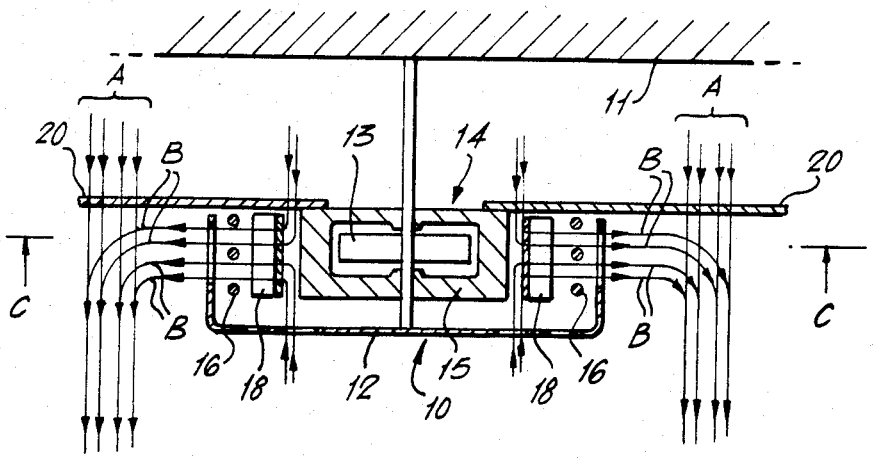
FIG. 1 is a diagrammatic representation of a ceiling fan in accordance with the invention.
Figure 2:
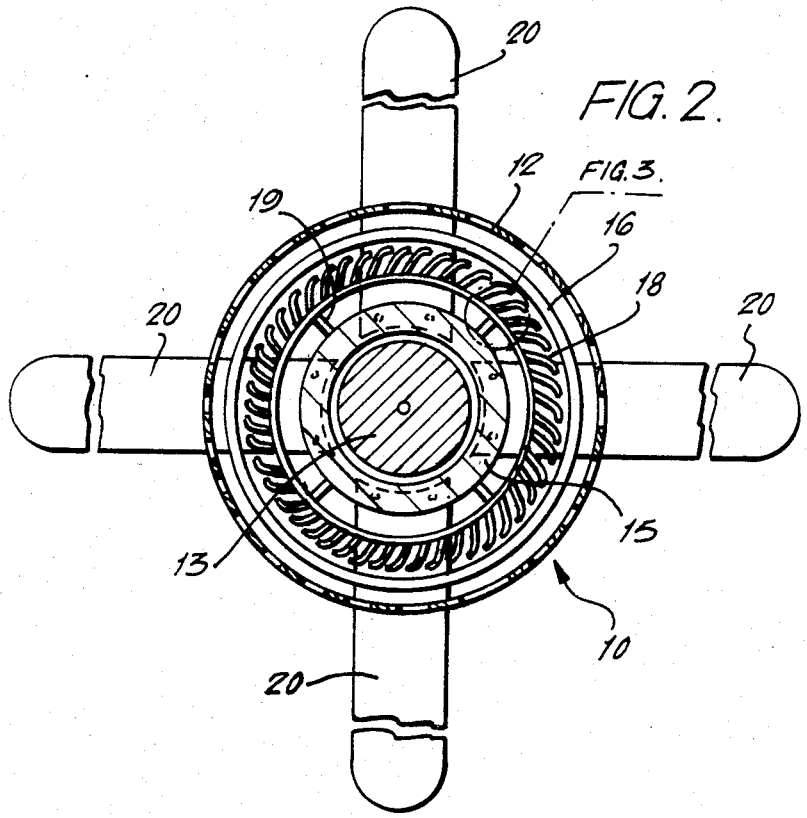
FIG. 2 is a cross sectional view of the ceiling fan of FIG. 1 along line C—C.
Figure 3:
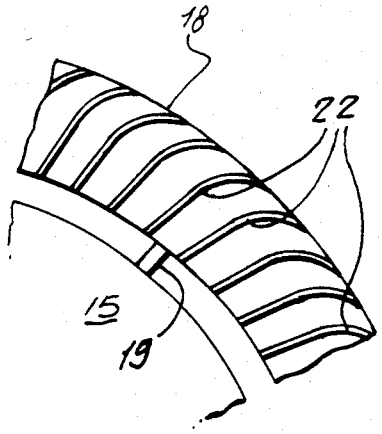
FIG. 3 is an enlarged view of a portion shown in FIG. 2.

The ceiling fan 10 shown in the drawings is supported from a ceiling 11 and comprises a housing 12 containing, a conventional motor 14 with a central stationary stator 13 and outer rotatable rotor 15. Also in the housing are annular heating elements 16 positioned around the outside of the motor 14 and a radial fan 18. A number of blades 20 are supported on the upper surface of the rotor 15 such that when the rotor rotates a downward steam of air (see arrows A) is created by the blades 20.

A secondary stream of air is produced by the radial fan 18 which generates a flow of air (see arrows B) through the housing 12 over the heating elements 16, causing the air to be heated, and out into the downward stream of air created by the blades 20 through holes in the side of the housing.

The fan 10 can thus be used in two modes. Firstly, during hot or warm conditions, the heating elements are turned off and the fan used as a conventional ventilation and cooling fan. Secondly, during cold or cool conditions, the heating elements 16 are activated and the fan used as a combined heater and ventilation fan.

The radial fan or blower 18 is supported by supports 19 mounted on the rotor 15 such that it rotates relative to the stationary heating elements 16, stator 13 and housing 14. The radial fan 18 comprises a number of fan blades members 22 which are straight over most of their length but turned in at their outer ends such that air is drawn through the gap between the fan or blower 18 and rotor 15 and passes over the heating elements 16. The radial fan imparts some tangential flow component to the air passing through the housing and this can increase the amount by which the air is heated. The fan prevents significant heat build-up in the rotor or heating elements, and forces the hot air into the downward air stream A. Preferably, the fan 18, rotor 15 and blades 20 rotate in the approximate range of speeds that conventional ceiling fans rotate.

The blades 20 are mounted on the upper portion of the rotor 15 such that they rotate above the area where the heated air (see arrows B) is emitted from the housing 12 causing the heated air to move in a downward direction with the stream of air created by the blades (see arrows A). The heated air mixed with the stream of air and warms that air.

The air flowing through the housing (see arrows B) is preferably relatively smaller in volume and quicker moving than the volume of air in the downward stream (see arrows A) such that only a smaller amount of air is heated to warm up a larger volume of air.

The advantage of heating a relatively smaller volume of air is that only a small heating unit needs to be used but a relatively large volume of air can still be warmed. A smaller and lighter heating unit can be easily supported in the housing hung from the ceiling. Alternatively, a larger and heavier heating unit would have to be used to warm up the large volume of air and this would be impractical as the unit would be too heavy to be supported in a ceiling fan which is supported from a ceiling.

Another advantage of heating a relatively small volume of air is that the radial fan has only to force a small volume of air through the housing and accordingly uses a minimum amount of energy.

An advantage of forcing the air through the housing relatively quickly is that the ceiling fan will not "heat up" significantly due to the heat build-up in the heating unit and rotating rotor as any hot air is quickly removed from the housing. A thermostat can be used also to prevent excessive heat build-up.

As noted in the Consumer Reports (published by Consumers Union) July 1982 edition P.351 the cooling effect of a conventional ceiling fan when used to re-circulate warmer air lying adjacent the ceiling tends to outweigh any improvement in temperature distribution in a room. The ceiling fan in accordance with the invention overcomes this problem by providing heating elements within the housing to heat the stream of air caused by the blades.

An advantage of a ceiling fan in accordance with the invention over conventional blow fan heaters is that all the air in a small or middle sized room is circulated by the ceiling fan and gently warmed up which is in contrast with a blow fan heater where a concentrated stream of hot air is emitted into the relatively colder room.

Tests involving a ceiling fan in accordance with the invention with heating elements with a 1.5 KW capacity have achieved a 14° F. (7.8° C.) rise in temperature of the air within the room of size of 14 ft.×14 ft. (3.5 m×3.5 m) in 20 minutes.

Figure 4:
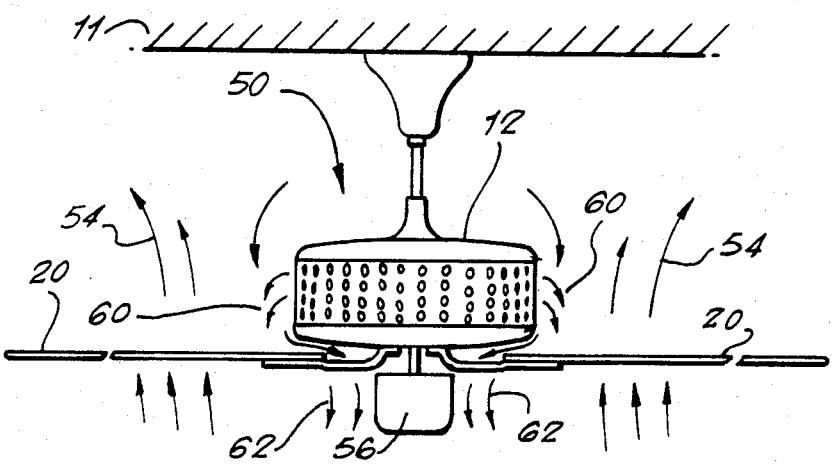
FIG. 4 is a diagrammatic elevation of an alternative ceiling fan showing the air flow.

FIG. 4 shows a modified ceiling fan 50 according to the invention. It differs from the fan 10 in that the blades 20 are mounted beneath the housing 12 and so cause the air to move upwardly past the housing in the direction of the arrows 54.

Hanging down beneath the housing 12 is a switch housing 56 containing switches and the like to enable the user to control the operation of the fan 50.

Heated air passes onto through the perforated side wall of the housing in the same way as for the fan 10 in the direction of the arrows 60 and mixes with the upward stream of air produced by the blades 20.

With such a fan 50 we have found that the central axial region of the housing and the switch housing 56 can overheat, particularly if the fan 50 is mounted close to the ceiling 11 since the air can rebound down from the ceiling axially of the housing and very hot air can then pass downwardly in the direction of the arrows 62. One reason for this may be because the blades 20 do not extend for aesthetic reasons close to the axis of rotation.

Figure 5:
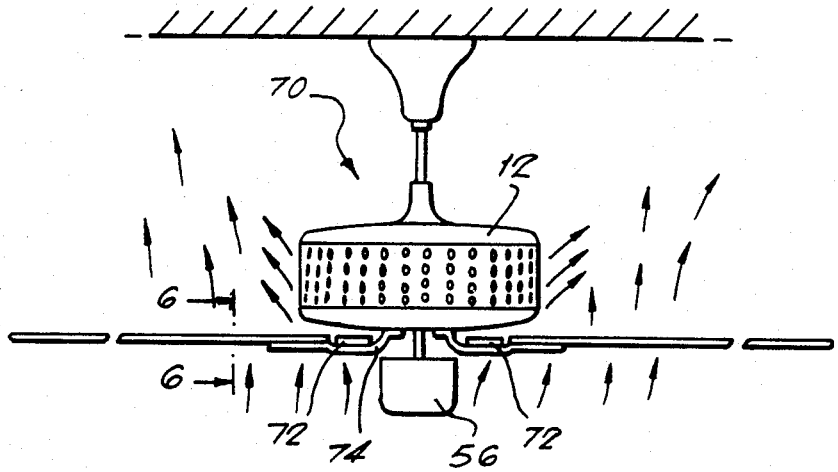
FIG. 5 is an elevation similar to FIG. 4 of a further modified fan.
Figure 6:
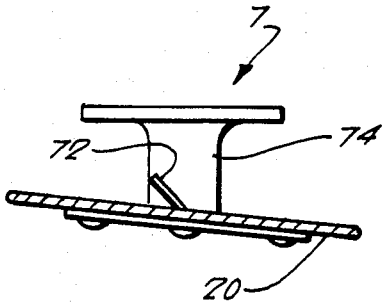
FIG. 6 is an enlarged section taken on the line 6—6 of FIG. 5.

To overcome this problem the further modified ceiling fan 70 shown in FIG. 5 includes small supplementary blades or flips 72. These are, as best shown, in FIG. 6 angled at a steeper angle of attack to the air than the blades 20. They thus create a reasonable upward air flow in the central region of the housing 12 and switch housing 56. In addition it can be seen how they extend inwardly beyond the innermost ends of the blades 20 over the arms 74 by means of which the blades 20 are attached to the arms.

Figure 7:
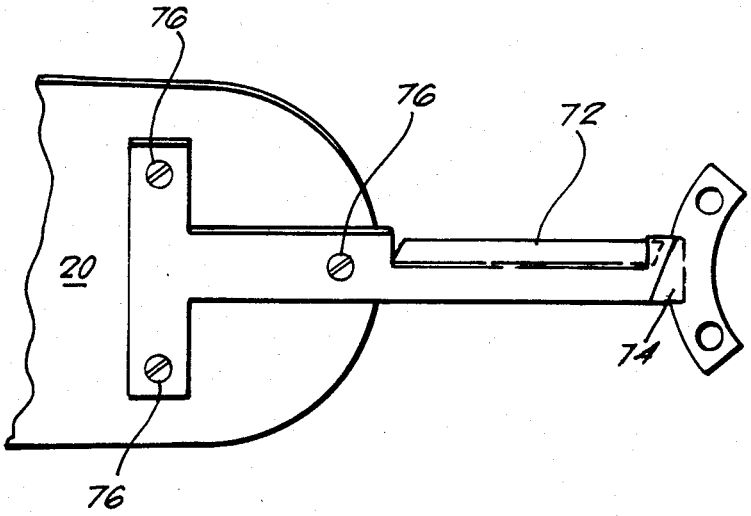
FIG. 7 is a plan detail taken in the direction of the arrow 7 of FIG. 6.

Further for simplicity as shown in FIG. 7 the supplementary blades 72 have been formed from a thin piece of metal attached by the screws 76 which attach the arms 74 to the blades 20.

As can be seen from the arrows on FIG. 5 a flow of air is now created near the axis of the fan so cooling the switch housing 56 and centre of the housing 12.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

We claim:

1. A ceiling fan for optionally heating or cooling a room comprising a housing adapted to be suspended from a ceiling and including an aperture arranged so that air can flow through the housing; a motor disposed within the housing and having a stationary stator and a rotatable rotor; a selectively energizable electric heating element disposed within the housing and spaced from the motor; first fan means attached to the rotor and disposed exteriorly of the housing for generating a relatively large volume air flow on the exterior of the housing; and second fan means for generating a relatively small volume flow and positioned to pass the small volume air flow over the heating element and through the housing aperture so that the small volume air flow can be heated.

2. A ceiling fan as claimed in claim 1 wherein said second fan means is connected to the rotor of said motor such that said second fan means rotates with said rotor.

3. A ceiling fan as claimed in either claim 1 or claim 2 wherein said second fan means comprises a radial fan element positioned within the housing and around the outside of the motor so that air passes over the heating elements and is emitted into the stream of air generated by said first fan means.

4. A ceiling fan as claimed in claim 3 wherein the flow of air through the housing is emitted in a tangential and radial direction into the stream of air generated by the first fan means.

5. A ceiling fan as claimed in claim 1 wherein said first fan means includes blades mounted on said rotor such that they rotate above the area where the heated air is emitted from the housing aperture, causing the heated air to move in a downward direction.

6. A ceiling fan as claimed in claim 1 wherein the first fan means includes blades mounted on the rotor such that they rotate below the area where the heated air is emitted from the housing aperture, causing the heated air to move in an upward direction.

7. A ceiling fan comprising a housing adapted to be suspended from a ceiling and including an aperture arranged so that air can flow through the housing; a motor disposed within the housing and having a stationary stator and a rotatable rotor; an electric heating element disposed within the housing and spaced from the motor; first fan means attached to the rotor and disposed exteriorly of the housing for generating a relatively large volume air flow on the exterior of the housing; and second fan means for generating a relatively small volume air flow and positioned to pass the small volume air flow over the heating element and through the housing aperture so that the small volume air flow can be heated.

8. A ceiling fan as claimed in claim 7 wherein said second fan means is connected to the rotor of said motor such that said means rotates with said rotor.

9. A ceiling fan as claimed in either claim 7 or claim 8 wherein said second fan means comprises radial fan element positioned within the housing and around the outside of the motor so that air passes over the heating elements and is emitted into the stream of air generated by said first fan means.

10. A ceiling fan as claimed in claim 9 wherein the flow of air through the housing aperture is emitted in a trangential and radial direction into the stream of air generated by the first fan means.

11. A ceiling fan as claimed in claim 7 wherein said first fan means includes blades mounted on said rotor such that they rotate above the area where the heated air is emitted through the housing aperture, causing the heated air to move in a downward direction.

12. A ceiling fan as claimed in claim 7 wherein the first fan means includes blades mounted on the rotor such that they rotate below the area where the heated air is emitted from the housing aperture, causing the heated air to move in an upward direction.

13. The ceiling fan of claim 7 wherein said first fan means comprises a number of fan blades rotatable by said rotor, said blades including supplementary portions of increased angularity disposed towards the center of rotation of said blades.

14. A ceiling fan for optionlly heating and cooling a room comprising a housing adapted to be suspended from a ceiling and including a plurality of apertures arranged so that air can flow through the housing; a motor disposed within the housing and having a stationary stator and a rotatable rotor; an electric heating element disposed within the housing and spaced from the motor; first fan means attached to the rotor and disposed exteriorly of the housing for generating a relatively large volume air flow on the exterior of the housing; second fan means for generating a relatively small volume flow and positioned to pass the small volume air flow over the heating elements and through the housing apertures; and means for energizing and deenergizing the heating element independently of the motor so that the small volume air flow can be optionally heated.

* * * * *